US011541501B1

(12) United States Patent
Chen

(10) Patent No.: US 11,541,501 B1
(45) Date of Patent: Jan. 3, 2023

(54) CUTTER SHARPENER

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/406,123

(22) Filed: Aug. 19, 2021

(30) Foreign Application Priority Data

Jul. 14, 2021 (CN) ..... 2021216017597

(51) Int. Cl.

| | |
|---|---|
| ***B24B 3/36*** | (2006.01) |
| ***B24D 15/06*** | (2006.01) |
| ***B24B 3/52*** | (2006.01) |
| ***B24B 3/54*** | (2006.01) |
| ***B24B 7/07*** | (2006.01) |
| ***B24D 15/08*** | (2006.01) |

(52) U.S. Cl.
CPC ..... *B24B 3/36* (2013.01); *B24B 3/52* (2013.01); *B24B 3/54* (2013.01); *B24B 7/075* (2013.01); *B24D 15/063* (2013.01); *B24D 15/065* (2013.01); *B24D 15/08* (2013.01)

(58) Field of Classification Search
CPC .... B24D 15/06; B24D 15/063; B24D 15/065; B24D 15/08; B24B 3/00; B24B 3/36; B24B 3/006; B24B 3/52; B24B 3/54; B24B 3/543; B24B 3/546; B24B 3/55; B24B 3/361; B24B 3/44; B24B 3/48; B24B 7/07; B24B 7/075
See application file for complete search history.

(56) References Cited

U.S. PATENT DOCUMENTS

| | | | | |
|---|---|---|---|---|
| 4,217,735 A * | 8/1980 | McGeoch | B24D 15/06 | 451/321 |
| 4,229,910 A * | 10/1980 | McRae | B24D 15/08 | 76/82 |
| 4,404,873 A * | 9/1983 | Radish | B24D 15/06 | 269/3 |
| 5,185,958 A * | 2/1993 | Dale | B24D 15/06 | 451/174 |
| 5,195,275 A * | 3/1993 | McLean | B24B 3/36 | 269/160 |
| 5,431,068 A * | 7/1995 | Alsch | B24B 41/066 | 269/3 |
| 8,262,438 B1 * | 9/2012 | Allison | B24D 15/08 | 451/321 |

(Continued)

OTHER PUBLICATIONS

'The TSPROF K03 Knife Sharpener—This thing is sweet!' (Simple Little Life) Jun. 18, 2019, [online], [retrieved from the internet on Feb. 1, 2022] <URL: https://www.youtube.com/watch?v=6U8dd1ZzjTg > (Year: 2019) (Year: 2019).*

*Primary Examiner* — Joel D Crandall
*Assistant Examiner* — Makena S Markman

(57) ABSTRACT

The present utility model provides a cutter sharpener including a housing, a height adjusting mechanism and a cutter clamping mechanism mounted on the housing, and a grinding mechanism rotatably connected to the height adjusting mechanism. The housing includes a first mounting location, the height adjusting mechanism is movably connected to the first mounting location, the height adjusting mechanism includes a lifting body, and the lifting body can move up and down relative to the first mounting location. The cutter sharpener further includes a degree indicating mechanism fixedly connected to the lifting body.

6 Claims, 4 Drawing Sheets

(56) References Cited

U.S. PATENT DOCUMENTS

| | | | | |
|---|---|---|---|---|
| 9,221,144 | B2 * | 12/2015 | Powell | B24B 9/04 |
| 10,272,535 | B1 * | 4/2019 | Lyons | B24B 49/04 |
| 2007/0218819 | A1 * | 9/2007 | Schwaiger | B24B 47/12<br>451/371 |

* cited by examiner

CUTTER SHARPENER

TECHNICAL FIELD

The present utility model relates to the technical field of cutter grinding, in particular to a manual cutter sharpener.

BACKGROUND ART

It is often difficult for large electric sharpening cutters to be used in cutting edge grinding of small portable cutters, especially in home or outdoor, and like occasions. While manual cutter sharpening tools are often too simple and crude, or dependent on a user's skill too much, inexperienced users or users lacking inexperience cannot achieve a good sharpening effect.

The patent application of a Chinese invention with the publication number CN106392784A discloses a knife sharpening bracket for sharpening the cutting edge of a knife; the knife sharpening bracket comprises a supporting frame and a clamping block which is mounted on the supporting frame; the clamping block is connected with a pressing plate through a bolt; two vertical plates are mounted at one side of the clamping block; a horizontal supporting plate provided with a plurality of through holes is mounted between the two vertical plates; the vertical plate is provided with a plurality of mounting holes; the horizontal supporting plate is connected with the two vertical plates through bolts; a pull rod provided with a handle penetrates into the horizontal supporting plate; a piece of knife sharpening stone is mounted on the pull rod; a limiting baffle mounted on the supporting frame is arranged at the other side of the clamping block; the limiting baffle is provided with a plurality of limiting grooves. The application provides a good idea to help users lacking experience control the angle of sharpening a cutter and help to fix the cutter; however, the grinding angle still needs to be adjusted according to the judgment of the user, the height adjustment needs the horizontal supporting plate to be repeatedly disassembled and installed, and the adjustment precision is not high.

SUMMARY OF THE INVENTION

The technical problem to be solved by the present utility model is to provide a cutter sharpener that is convenient to accurately adjust an angle and simple and convenient to operate to overcome the defects in the prior art.

The technical scheme adopted by the present utility model for solving the aforementioned technical problems is:

a cutter sharpener, comprising a housing, a height adjusting mechanism and a cutter clamping mechanism mounted on the housing, and a grinding mechanism rotatably connected to the height adjusting mechanism, wherein the housing comprises a first mounting location, the height adjusting mechanism is movably connected to the first mounting location, the height adjusting mechanism comprises a lifting body, and the lifting body can move up and down relative to the first mounting location; the cutter sharpener further comprising a degree indicating mechanism fixedly connected to the lifting body.

Further, the cutter sharpener further comprises a connecting mechanism, and the grinding mechanism is rotatably connected to the lifting body through the connecting mechanism.

Further, the degree indicating mechanism comprises a degree indicating plate, and scales of the degree indicating plate are distributed circumferentially, the connecting mechanism being connected to the lifting body through a first connecting shaft, and an axis of the first connecting shaft passing through a center of a circle where the scale of the degree indicating plate is located.

Further, the connecting mechanism comprises a first connecting member and a second connecting member rotatably connected to the first connecting member, rotational directions of the first connecting member and the second connecting member are perpendicular to each other, and the first connecting member is coaxially and rotatably connected to the first connecting shaft.

Further, the first connecting member is provided with a pointer thereon for indicating the scale on the degree indicating plate.

Further, the degree indicating mechanism further comprises a magnet connected to the first connecting shaft, and a magnetically attracting member is arranged inside the first connecting member.

Further, the grinding mechanism comprises a handle and a grinding body mounted on the handle, the handle being detachably connected to the second connecting member by a connecting rod.

Further, the housing comprises a second mounting location at which the cutter clamping mechanism is mounted, the cutter clamping mechanism comprising a clamping portion and an adjusting portion movably connected, with the adjusting portion for adjusting an opening interval of the clamping portion.

Further, the clamping portion comprises an upper clamp and a lower clamp rotatably connected, the upper clamp abutting against the adjusting portion.

Further, the adjusting portion comprises an adjusting screw rod, an adjusting block, which has an inclined surface, cooperating with the adjusting screw rod, and an adjusting wheel movable along the inclined surface, the adjusting block being provided with an adjusting internal thread cooperating with an external thread of the adjusting screw rod, the adjusting wheel being rotatably connected to the upper clamp, and an outer edge of the adjusting wheel abutting against the inclined surface.

DETAILED DESCRIPTION OF THE INVENTION

Figure 1:
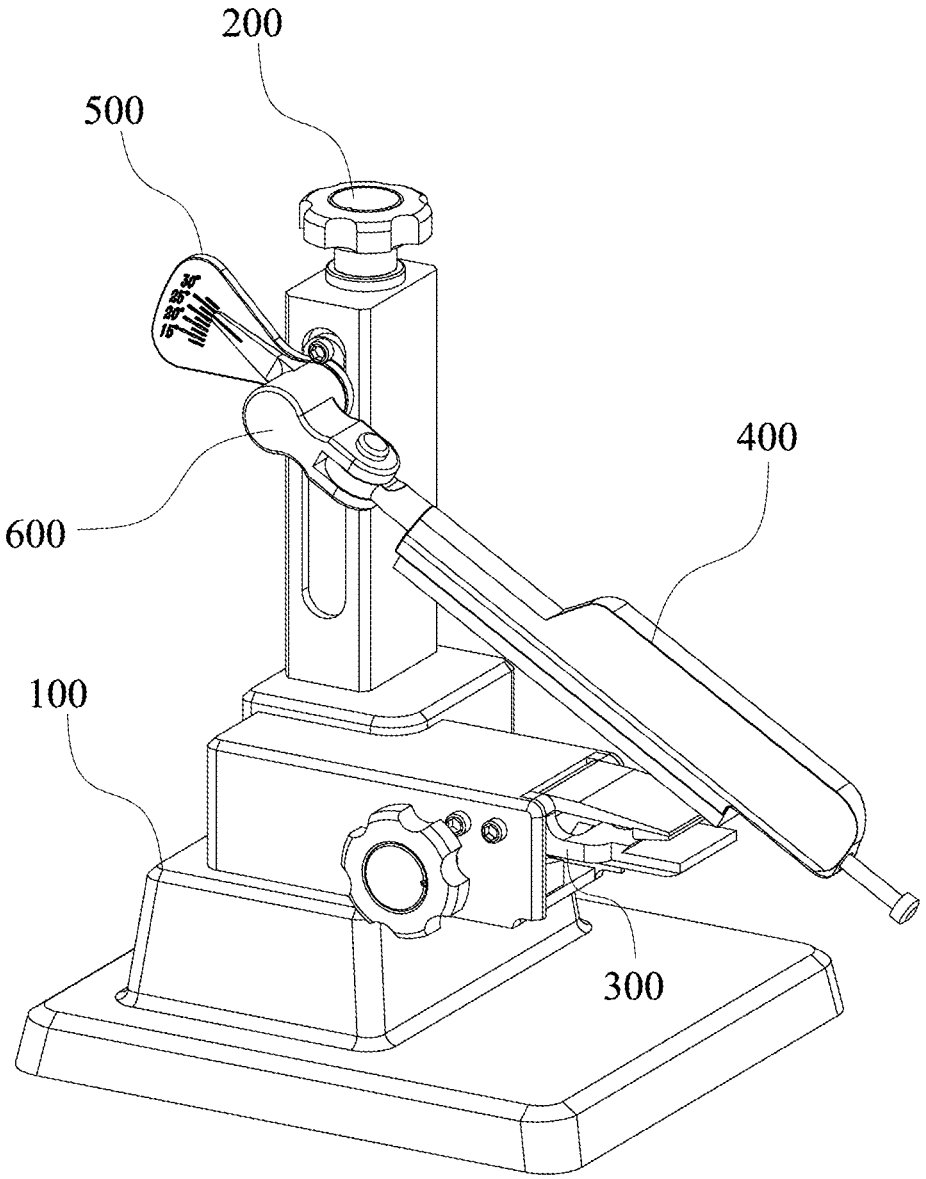
FIG. 1 is a schematic view showing an overall structure of a cutter sharpener according to the present utility model.

The present utility model is described in further detail below with reference to the embodiments of the accompanying drawings.

Reference is made to FIGS. 1-6. The cutter sharpener of the present utility model includes a housing 100, a height adjusting mechanism 200 and a cutter clamping mechanism 300 respectively mounted on the housing 100, and a grinding mechanism 400 rotatably connected to the height adjusting mechanism 200. The height adjusting mechanism 200 is movably connected to a first mounting location 110 on the housing 100. In one embodiment, the height adjusting mechanism 200 includes a lifting body 203, a first driving member 201, and a second driving member 202 fixedly connected to the first driving member 201. In one embodiment, the first driving member 201 is a knob, the second driving member 202 is a screw rod fixedly connected to the knob, and the lifting body 203 is internally provided with an internal thread 204 matched with the external thread of the screw rod. When the knob is rotated to drive the screw rod to rotate, the lifting body 203 moves up and down within the range of height H along the axial direction of the screw rod in the first mounting location 110. In other embodiments, the lifting body 203 can move up and down relative to the first mounting location; however, according to practical use requirements, the displacement distance of the lifting body 203 in the vertical direction may be far smaller than H. In other embodiments, the lifting body 203 can be driven to move up and down in other manners. But the fine height adjustment of the lifting body 203 can be realized in the manner that the screw rod is matched with the internal thread 204 of the lifting body 203. Because of the adjustment precision and good stability, it is a preferred embodiment.

Figure 2:
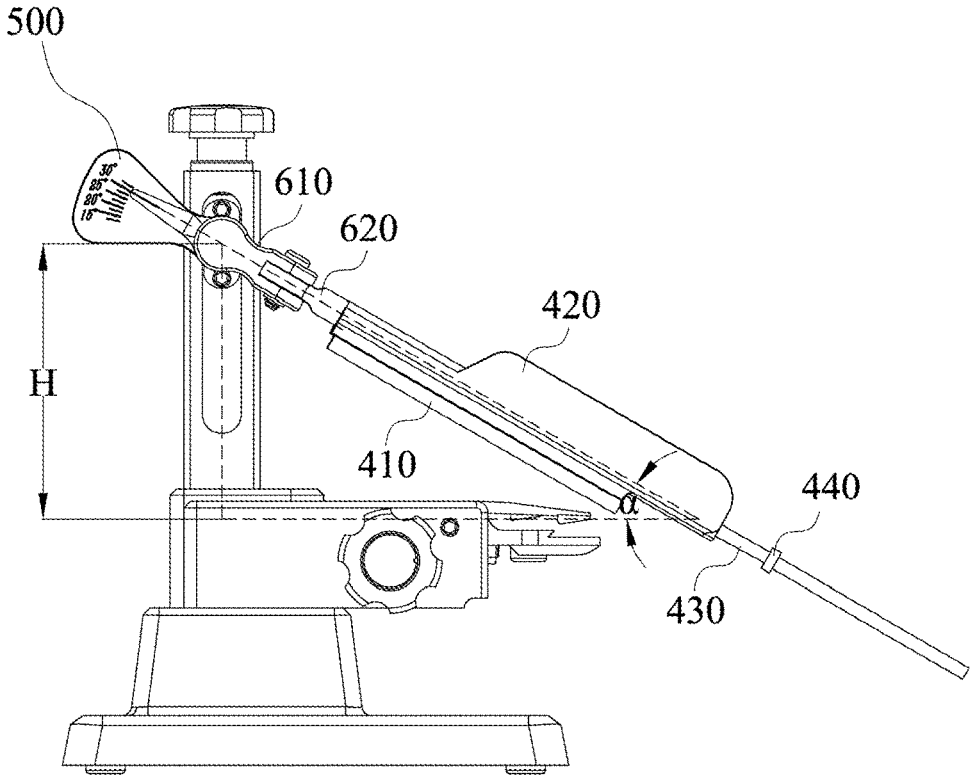
FIG. 2 is a front view of a cutter sharpener according to the present utility model.
Figure 3:
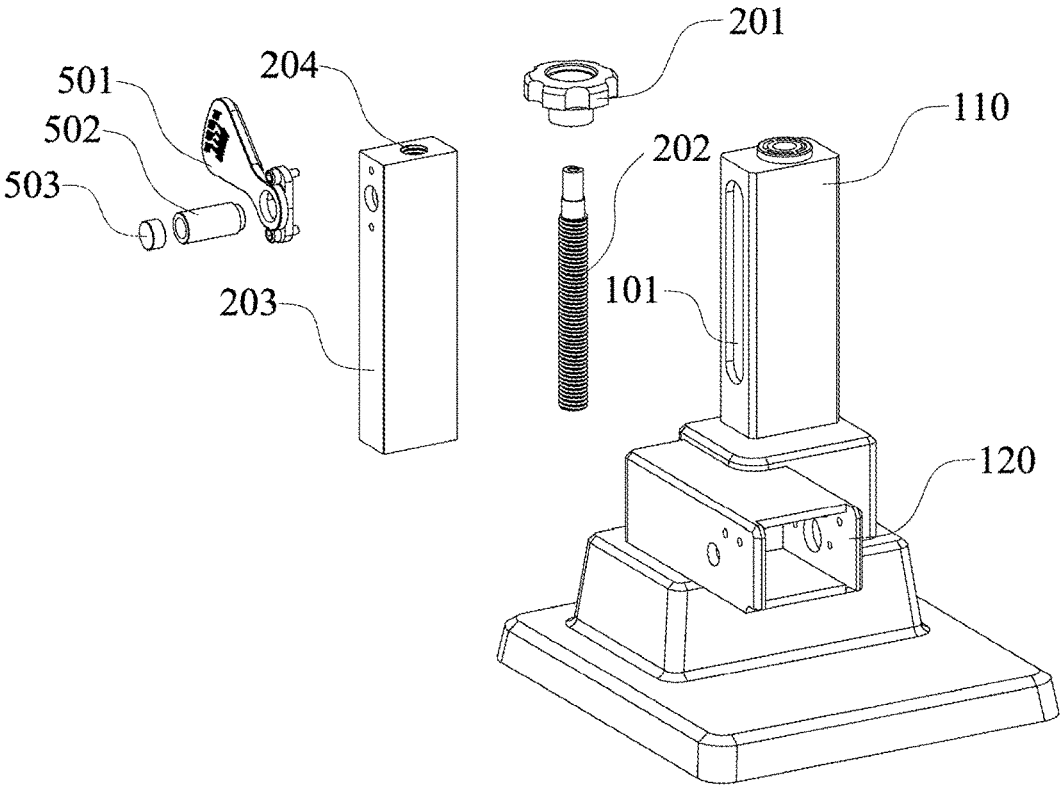
FIG. 3 is a schematic view showing an exploded structure of a housing, a degree indicating mechanism and a height adjusting mechanism of a cutter sharpener according to the present utility model.

As shown in FIG. 2, a degree indicating mechanism 500 is fixedly connected to the lifting body 203, and the degree indicating mechanism 500 includes a degree indicating plate 501 located in a vertical plane. The degree indicating plate 501 is provided with scales distributed along the circumference used for indicating a certain range of angles. In one embodiment, the scale indicates an angle in the range of 10°-35°. The angle refers to an angle of an acute included angle $\alpha$ that the extension line of the scale forms with respect to the horizontal plane, which is perpendicular to the vertical plane in which the degree indicating plate 501 lies. In the present utility model, the grinding mechanism 400 is rotatably connected to the lifting body 203 of the lifting mechanism 200 through the connecting mechanism 600.

Figure 4:
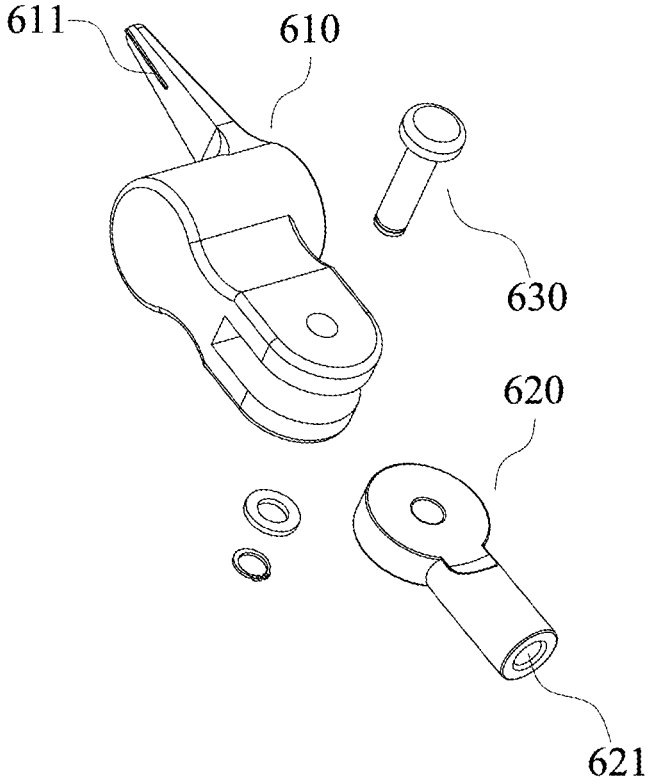
FIG. 4 is a schematic view showing an exploded structure of a connecting mechanism of a cutter sharpener according to the present utility model.

In one embodiment, the connecting mechanism 600 includes a first connecting member 610 and a second connecting member 620 rotatably connected to the first connecting member 610, the second connecting member 620 being fixedly connected to the grinding mechanism 400 and the first connecting member 610 being rotatably connected to the lifting body 203. In one preferred embodiment, the center of rotation of the first connecting member 610 is coaxial with the center of the circle on which the scale of the degree indicating plate 501 is located. In one embodiment, the axis of a first connecting shaft 502 passes perpendicularly through the center of the circle where the scale of the degree indicating plate 501 is located, the first connecting shaft 502 is fixedly connected to the lifting body 203, and the center of rotation of the first connecting member 610 is coaxial with the shaft center of the first connecting shaft 502. As shown in FIG. 4, the first connecting member 610 is provided with a radially arranged pointer 611 thereon. At this time, when the first connecting member 610 rotates about the first connecting shaft 502, the pointer 611 swings and indicates the scale on the degree indicating plate 501, and a user can directly read and determine the angle of the grinding mechanism 400 with respect to the horizontal plane at this time.

In one embodiment, the first mounting location 110 is provided with a vertical opening 101 that allows the first connecting shaft 502 to extend outwardly from the first mounting location 110, the vertical height of the vertical opening 101 being smaller than the height H.

In one embodiment, the rotational directions of the first connecting member 610 and the second connecting member 620 are perpendicular to each other. In one embodiment, the first connecting member 610 is rotatably connected to the second connecting member 620 through the second connecting shaft 630, the extension line of the pointer 611 of the first connecting member 610 forms a first plane with the axis of the first connecting shaft 502, the rotational plane of the second connecting member 620 is a second plane, the first plane is parallel to or coincident with the second plane, and the axis of the second connecting shaft 630 is perpendicular to the first plane and the second plane. Therefore, when the first connecting member 610 is rotated in the vertical plane with respect to the first connecting shaft 502, the grinding mechanism 400 achieves angular adjustment in the vertical plane. When the second connecting member 620 is rotated in the second plane with respect to the second connecting shaft 630, the grinding mechanism 400 further achieves angular adjustment in the second plane perpendicular to the aforementioned vertical plane, thereby theoretically achieving universally angular adjustment. Of course, such a wide range of angular adjustments may not be required in practical usage.

In one embodiment, the degree indicating mechanism 500 further includes a magnet 503 connected to the first connecting shaft 502. A magnetically attracting member (not shown in the figure) is arranged inside the first connecting member 610 such that a labor-saving mounting can be realized by making the first connecting member 610 close to the first connecting shaft 502. Besides, the disassembling is also convenient. Based on this idea, a person skilled in the art would also be able to propose a similar labor-saving mounting mechanism, which will not be described in detail herein.

The grinding mechanism 400 includes a handle 420 detachably connected to the second connecting member 620 and a grinding body 410 mounted on the handle 420, the grinding body 410 being an entity capable of grinding a cutting edge, such as a grindstone or like textures. In one embodiment, one side of the grinding body 410 that contacts the cutting edge is a plane, and the plane is parallel to the second plane. The handle 420 is detachably connected to the second connecting member 620 through the connecting rod 430. In one embodiment, the connecting rod 430 axially passes through the handle 420 and allows the handle 420 to slide back and forth along the axis of the connecting rod 430 such that each portion of the grinding body 410 can be uniformly used, thereby prolonging the service life of the grinding body 410. In one embodiment, one end of the connecting rod 430 is inserted into the first end 621 of the second connecting member 620, and the other end of the connecting rod 430 is provided with a stopping portion 440 to prevent the handle 420 from separating from the connecting rod 430. The handle 420 is provided with a curved surface to facilitate gripping by a user. In one embodiment, the curved surfaces are symmetrically arranged along the axial direction of the handle 420. In one embodiment, the curved surface has anti-slip property.

Figure 5:
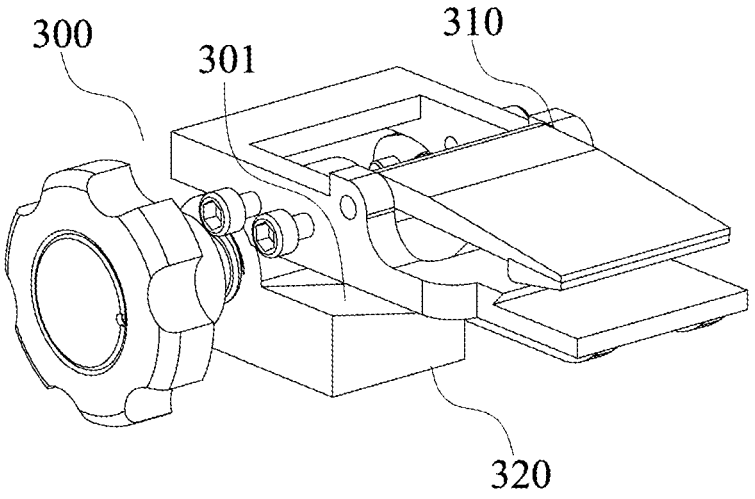
FIG. 5 is a schematic view showing a structure of a cutter clamping mechanism of a cutter sharpener according to the present utility model.
Figure 6:
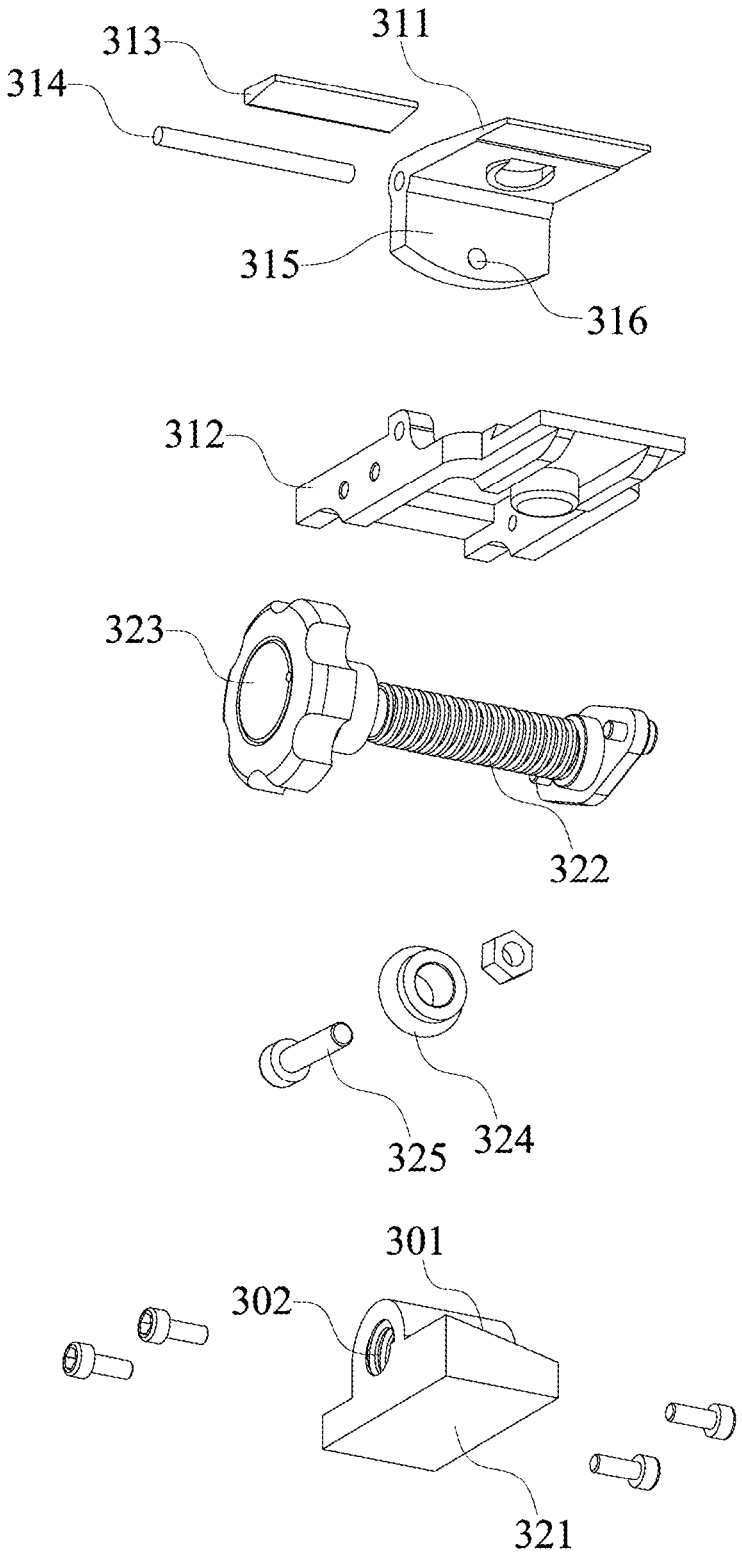
FIG. 6 is a schematic view showing the exploded structure of FIG. 5.

As shown in FIG. 5, the cutter clamping mechanism 300, mounted on a second mounting location 120 of the housing 100, includes a clamping portion 310 and an adjusting portion 320 movably connected, the latter for adjusting the opening interval of the clamping portion 310 to achieve the clamping and releasing of a blade to be ground. The clamping portion 310 includes an upper clamp 311 and a lower clamp 312 connected to each other. In one embodiment, the upper clamp 311 is rotatably connected to the lower clamp 312 by a third connecting shaft 314. The adjusting portion 320 includes an adjusting knob 323 and an adjusting screw rod 322 fixedly connected to the adjusting knob 323, an adjusting block 321, which has an inclined surface 301, cooperating with the adjusting screw rod 322, and an adjusting wheel 324 movable along the inclined surface 301. The adjusting block 321 is provided with an adjusting internal thread 302 cooperating with the external thread of the adjusting screw rod 322.

In one embodiment, the upper clamp 311 is rotatably connected to the adjusting wheel 324 by a shaft 325. The upper clamp 311 is provided with an extending section 315, which has a hole 316. The rotating shaft 325 passes through the hole 316 and the adjusting wheel 324 sequentially. In one embodiment, the lower clamp 312 is hollow and the extending section 315 passes from top to bottom through the hollow space of the lower clamp 312; the inclined surface 301 of the adjusting block 321 abuts against the outer edge of the adjusting wheel 324 such that when the adjusting knob 323 is rotated to drive the adjusting screw rod 322 to rotate, the adjusting block 321 moves from one end of the adjusting screw rod 322 to the other end, the vertically upward pressure exerted by the inclined surface 301 on the adjusting wheel 324 is increased or decreased accordingly, the height of the adjusting wheel 324 in the vertical direction is increased or decreased accordingly, and the adjusting wheel 324 drives the upper clamp 311 to lift or fall to adjust the opening interval of the clamping portion 310. In one embodiment, an anti-slip pad 313 is arranged on the inner side of the opening of the clamping portion 310. In one embodiment, the anti-slip pad 313 is fixedly connected to the upper clamp 311 and/or lower clamp 312.

What is claimed is:

1. A cutter sharpener, comprising: a housing, a height adjusting mechanism and a cutter clamping mechanism mounted on the housing, and a grinding mechanism rotatably connected to the height adjusting mechanism, wherein the housing comprises a first mounting location, the height adjusting mechanism is movably connected to the first mounting location, the height adjusting mechanism comprises a lifting body, a knob, and a screw rod fixedly connected to the knob; and the lifting body can move up and down relative to the first mounting location; the cutter sharpener further comprising a degree indicating mechanism fixedly connected to the lifting body;

wherein the lifting body is internally provided with an internal thread matched with the external thread of the screw rod; when the knob is rotated to drive the screw rod to rotate, the lifting body moves up and down along an axial direction of the screw rod in the first mounting location, an axial direction of the knob is parallel with a moving direction of the lifting body;

wherein the cutter sharpener further comprises a connecting mechanism, and the grinding mechanism is rotatably connected to the lifting body through the connecting mechanism;

wherein the degree indicating mechanism comprises a degree indicating plate, and scales of the degree indicating plate are distributed circumferentially, the connecting mechanism being connected to the lifting body through a first connecting shaft, and an axis of the first connecting shaft passing through a center of a circle where the scale of the degree indicating plate is located; the first connecting shaft is connected with the degree indicating plate and the lifting body; the degree indicating plate is directly fixed connected with the lifting body;

wherein the connecting mechanism comprises a first connecting member and a second connecting member rotatably connected to the first connecting member, a free end the first connecting member is opposite to a free end of the second connecting member, rotational directions of the first connecting member and the second connecting member are perpendicular to each other, and the first connecting member is coaxially and rotatably connected to the first connecting shaft;

wherein the first connecting member is extended to form a pointer thereon for indicating the scale on the degree indicating plate which represents an angle of the grinding mechanism with respect to a horizontal plane, and an extending direction of the pointer is in opposite with an extending direction of the free end of the second connecting member;

wherein the first connecting member is rotatably connected to the second connecting member through a second connecting shaft, an extension line of the pointer of the first connecting member forms a first plane with the axis of the first connecting shaft, a rotational plane of the second connecting member is a second plane, the first plane is parallel to or coincident with the second plane, and an axis of the second connecting shaft is perpendicular to the first plane and the second plane.

2. The cutter sharpener according to claim 1, wherein the degree indicating mechanism further comprises a magnet connected to the first connecting shaft, and a magnetically attracting member cooperating with the magnet is arranged inside the first connecting member.

3. The cutter sharpener according to claim 1, wherein the grinding mechanism comprises a handle and a grinding body mounted on the handle, the handle being detachably connected to the second connecting member by a connecting rod, and the connecting rod axially passes through the handle and allows the handle to slide back and forth along the axis of the connecting rod such that each portion of the grinding body can be uniformly used.

4. The cutter sharpener according to claim 1, wherein the housing comprises a second mounting location at which the cutter clamping mechanism is mounted, the cutter clamping mechanism comprising a clamping portion and an adjusting portion movably connected, with the adjusting portion for adjusting an opening interval of the clamping portion.

5. The cutter sharpener according to claim 4, wherein the clamping portion comprises an upper clamp and a lower clamp rotatably connected, the upper clamp abutting against the adjusting portion.

6. The cutter sharpener according to claim 5, wherein the adjusting portion comprises an adjusting screw rod, an adjusting block, which has an inclined surface, cooperating with the adjusting screw rod, and an adjusting wheel movable along the inclined surface, the adjusting block being provided with an adjusting internal thread cooperating with an external thread of the adjusting screw rod, the adjusting wheel being rotatably connected to the upper clamp, and an outer edge of the adjusting wheel abutting against the inclined surface.

* * * * *